United States Patent [19]

Jarrett et al.

[11] Patent Number: 4,798,241

[45] Date of Patent: Jan. 17, 1989

[54] MIXED HELIX TURBULATOR FOR HEAT EXCHANGERS

[75] Inventors: Frank N. Jarrett; John E. Munch, Jr., both of Racine, Wis.

[73] Assignee: Modine Manufacturing, Racine, Wis.

[21] Appl. No.: 482,018

[22] Filed: Apr. 4, 1983

[51] Int. Cl.[4] ..... F28F 13/12

[52] U.S. Cl. ..... 165/109.1; 138/38; 165/179

[58] Field of Search ..... 165/48 R, 97, 102, 169, 165/179, 184, 109 T, 163, 156, DIG. 8; 138/38, 108, 114

[56] References Cited

U.S. PATENT DOCUMENTS

| | | | |
|---|---|---|---|
| 755,558 | 3/1904 | Barber | 138/38 |
| 1,865,422 | 7/1932 | Parrott | 140/149 |
| 2,500,501 | 3/1950 | Trumpler | 165/166 |
| 2,608,968 | 9/1952 | Mosely | 138/38 |
| 3,595,299 | 7/1971 | Weishoupt et al. | 165/179 |
| 3,951,175 | 4/1976 | Eberhart | 165/156 |
| 4,009,751 | 3/1977 | Zelnik | 165/179 |
| 4,044,796 | 8/1977 | Smick | 138/38 |
| 4,336,838 | 6/1982 | Ely | 165/109 T |
| 4,347,894 | 9/1982 | Gerlach | 165/163 |

FOREIGN PATENT DOCUMENTS

| | | | |
|---|---|---|---|
| 550986 | 11/1956 | Italy | 165/179 |
| 2097910 | 11/1982 | United Kingdom | 138/38 |

*Primary Examiner*—Steven E. Warner

*Attorney, Agent, or Firm*—Wood, Dalton, Phillips, Mason & Rowe

[57] ABSTRACT

An improved turbulator and conduit structure for use in heat exchangers. An elongated tube through which fluid to be subject to a heat exchange process is provided with a first outer winding within the tube in substantial abutment with the inner wall of the tube and a second inner winding at least partially within the first winding. The pitch of the first winding is different from the pitch of the second winding. Consistent heat exchange at extremely low Reynolds numberes is obtainable with the structure. Also disclosed is a method of making such a turbulator and conduit structure.

8 Claims, 2 Drawing Sheets

MIXED HELIX TURBULATOR FOR HEAT EXCHANGERS

FIELD OF THE INVENTION

This invention relates to turbulator structures employed in conduits which in turn are employed in heat exchangers.

BACKGROUND ART

Prior art of possible relevance includes U.S. Pat. No. 3,595,299 issued to Weishaupt et al and so-called single helix and double helix turbulators.

As is well known, the rate at which heat is exchanged in a heat exchanger through which a fluid, gaseous or liquid, is flowing is greatly affected by the nature of that flow, i.e., laminar, turbulant or transitional flow. Generally speaking, the more turbulant the flow, all other things being equal, the greater the rate of heat transfer. Stated another way, the higher the Reynolds number, the more rapid the rate of heat transfer.

However, in the design of heat exchangers, considerations other than solely that of high Reynolds numbers must be given great weight. High Reynolds numbers necessarily employ, all other things being equal, higher fluid velocities which in turn result in higher friction losses and therefore require more energy to generate.

A variety of other considerations frequently dictate a preference for relatively low Reynolds numbers of the heat exchange fluids which typically approach transitional or laminar zones. But, difficulties may be encountered when low Reynolds numbers are present in the heat exchange fluids in that slight changes in fluid flow introduced by small variations in pump performance or the like, including changes in pump speed may result in the fluid flow breaking down toward unstable transition flow or even laminar flow making it extremely difficult to obtain uniform heat transfer and/or desired rates of heat transfer.

In attempts to avoid such breakdown, the prior art has resorted to the use of so-called single or double helix turbulators in conduits housing fluids subject to a heat exchange process. Turbulators introduce turbulance into the fluid streams to maintain turbulant flow in conduits at Reynolds numbers whereat transition or laminar flow would occur without the presence of a turbulator. Such prior art turbulator structures as those identified above have been able to maintain turbulant flow heat transfer capability to relatively low Reynolds numbers but tend to allow fluid flow to break down toward unstable transition and/or laminar flow at Reynolds numbers frequently in the range of 1000–1500. Consequently, when using such devices, in order to sustain stable turbulant flow at low flow rates, resort has been made to multipass heat exchanger circuits which, of course, add expense to the heat exchange system.

Thus, there is a rear need for a turbulator that can extend the transition-laminar breakdown point to even lower Reynolds numbers to eliminate the need for multipass heat exchanger circuits or, at least, minimize the number of multipass circuits that are required in a given application.

SUMMARY OF THE INVENTION

It is the principal object of the invention to provide a new and improved turbulator structure for use in heat exchanger conduits. More specifically, it is an object of the invention to provide a turbulator and conduit structure for use in heat exchangers which is capable of lowering the point of fluid flow breakdown from turbulent flow to unstable transitional or laminar flow at Reynolds numbers significantly lower than the Reynolds numbers in which such breakdown occurs in prior art structures.

A further object of the invention is the provision of a method of making such a turbulator and conduit structure.

According to one facet of the invention, there is provided a turbulator and conduit structure for use in heat exchangers which includes an elongated conduit through which a fluid to be subject to a heat exchange process is adapted to be passed. A first outer winding is disposed within the tube in substantial abutment with the inner wall thereof and a second inner winding is likewise located within the tube and is at least partially within the first winding. The pitch of the first and second winding are different from each other.

In a preferred embodiment of the invention, the pitch of the second winding is greater than the pitch of the first winding.

Preferably, in a highly preferred embodiment, the pitch of the second winding is approximately 2.3–2.7 times the pitch of the first winding and both of the windings have the same direction of twist.

In a highly preferred embodiment of the invention, the tube has a circular cross section and the windings are helical. Preferably, the inner diameter of the first winding is approximately equal to the outer diameter of the second winding.

The invention also contemplates a method of making a turbulator and conduit structure for use in a heat exchanger including the steps of (a) providing a tube having a desired interior cross section, (b) forming a turbulator structure by winding a filament such that two sstrands of the filament are in spaced, generally parallel relation to each other and have an outer configuration of substantially the same shape and slightly lesser dimension than the interior cross section of the tube, (c) inserting the turbulator structure into the tube, and (d) partially, but not completely, removing one of the strands from the tube while maintaining the other strand within the tube.

In a preferred embodiment of the inventive method, step (b) above is performed by winding the filament on a mandrel and step (c) is performed by inserting the mandrel with the turbulator structure thereon into the tube.

Step (d) preferably is preceded by the step of removing the mandrel from the tube while leaving the turbulator structure in the tube.

In a highly preferred embodiment, wherein the method employs a mandrel, the mandrel is provided with a slotted end and the filament has a part intermediate its ends inserted in the slotted end of the mandrel prior to the performance of step (b). The remaining parts of the filament then define the previously mentioned strands.

In the usual case, the filament is formed of a wire.

Other objects and advantages will become apparent from the following specification taken in connection with the accompanying drawings.

DESCRIPTION OF THE PREFERRED EMBODIMENT

Figure 1:
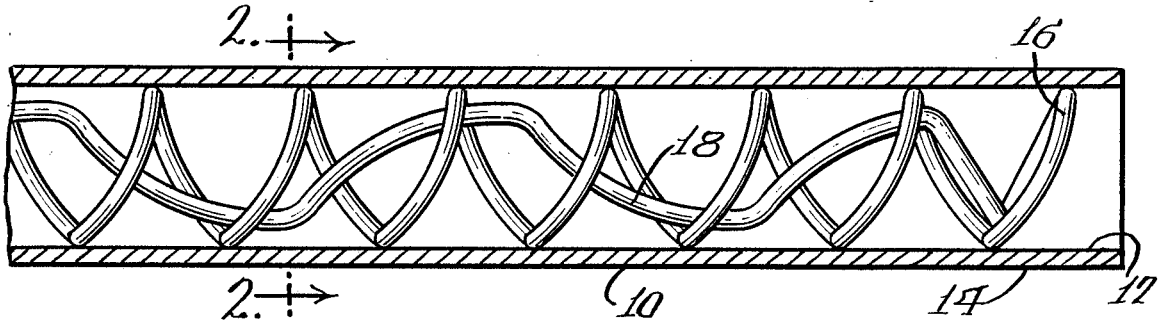
FIG. 1 is a sectional view of a conduit to which a fluid to be subject to a heat exchange process is adapted to be passed and which includes a turbulator made according to the invention.
Figure 2:
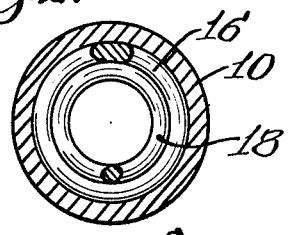
FIG. 2 is a sectional view taken approximately along the line 2—2 of FIG. 1.

An exemplary embodiment of a turbulator and conduit structure is illustrated in FIGS. 1 and 2 and is seen to include a conduit or tube 10 having an interior wall 12 and an exterior wall 14. In the usual case, the tube 10 will have a circular cross section as best seen in Fig. 2. However, it is to be understood that tubes having other cross sections, such as oval, annular, square or rectangular cross sections, can also be utilized as desired.

The tube 10 is adapted to have a fluid to be subjected to a heat exchange process passed therethrough. The fluid may be in either the liquid or gaseous state, dependent upon the desired application.

The tube 10 will also be formed of a good heat conductor, usually a metal, such as copper, brass or aluminum.

Within the tube 10 is a first winding 16, typically formed of wire or the like. The first winding is helical in configuration where a circular cross section tube is employed and has its convolutions substantially in abutment with the inner wall 12 of the tube 10.

Within the first winding is a second winding 18 which preferably is, but need not be, formed of the same wire forming the winding 16.

The second winding 18 is innermost with respect to the two windings 16 and 18, and is also helical in nature. In the usual case, the outer diameter of the inner winding 18 will be approximately equal to the inner diameter of the outer winding 16.

It will be further observed that the pitches of the two windings 16 and 18, that is, the distance between adjacent convolutions of the respective helixes, are substantially different. In a preferred embodiment, the pitch of the inner winding 18 is in the range of about 2.3–2.7 times the pitch of the outer winding 16.

Finally, it will be observed that both the windings 16 and 18 have a common hand or direction of twist.

The windings 16 and 18 may be retained within the tube 10 simply by utilizing the inherent resilience of the outer winding 16 and its frictional engagement with the inner wall 12 of the tube 10 as a maintaining force. Alternately, bonding methods such as soldering or brazing could be employed to secure the windings 16 and 18 within the tube 10.

One preferred method of making a turbulator and conduit structure made according to the invention includes, of course, the provision of a tube such as the tube 10 having a desired interior cross section as those mentioned previously. In the case of the circular cross section employed in the tube 10, there is also provided a cylindrical mandrel 30 having an end 32 provided with a slot 34.

Figure 3:
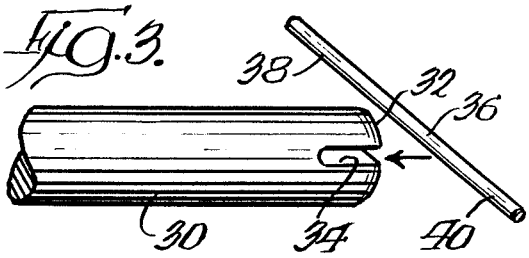
FIG. 3 illustrates an initial step in the performance of a method of making a turbulator and conduit structure according to the invention.

An elongated piece of wire to be employed to form the windings 16 and 18 is shown at 36 and intermediate its ends as shown in FIG. 3, is inserted in the slot 34 leaving the remainder of the wire in two strands 38 and 40.

The strands 38 and 40 are then tightly wrapped about the mandrel by effecting relative rotation between the same. Generally, it is desirable to rotate the mandrel 30 as indicated by an arrow 42.

Figure 4:
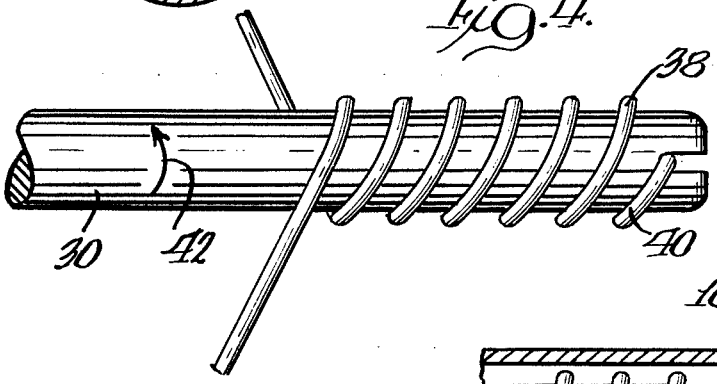
FIG. 4 illustrates a subsequent step in the method.

In rotating the mandrel 30, a double helix is defined by the strands 38 and 40 as best shown in Fig. 4. Stated another way, the strands 38 and 40 form a turbulator structure wherein the strands 38 and 40 are generally parallel to each other and have an outer configuration of substantially the same shape as the interior cross section of the tube 10. Preferably, the wire forming the strands 38 and 40, and the outer dimension of the mandrel 30, are selected such that the resulting wound structure has an outer diameter just slightly less than the inner diameter of the tube 10. A difference in the dimension on the order of 0.001–0.003 inches is generally satisfactory.

Figure 5:
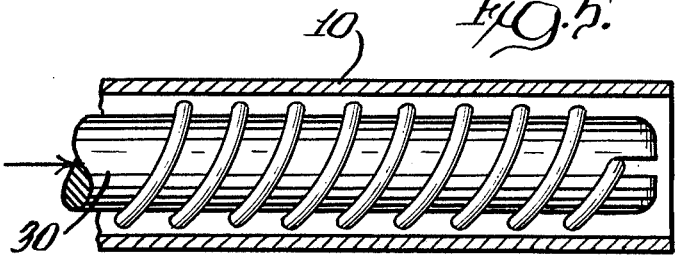
FIG. 5 illustrates a still later step in the method.
Figure 6:
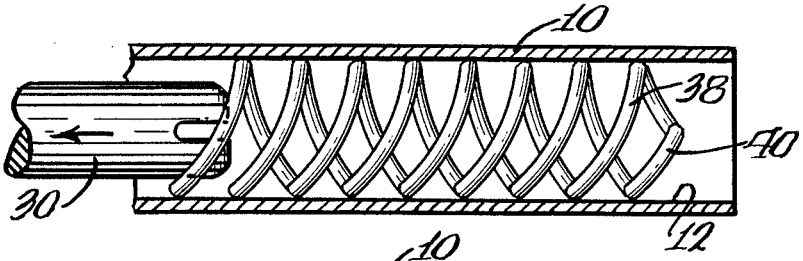
FIG. 6 illustrates a step subsequent to the step illustrated in FIG. 5.

With the strands 38 and 40 tightly wound upon the mandrel 30 such that they remain under tension, the mandrel 30 is inserted into the tube 10 as illustrated in FIG. 5. Tension is then released on the strands 38 and 40 and their inherent resilience will cause the convolutions of both strands to expand and frictionally engage the inner wall 12 of the tube 10. This same expansion will result in the release of any frictional grip of the strands 38 and 40 on the exterior surface of the mandrel 30 so that the mandrel 30 may be withdrawn from the tube as illustrated in FIG. 6.

Figure 7:
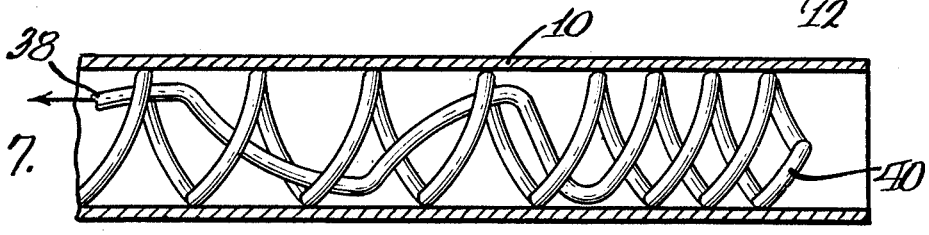
FIG. 7 illustrates still a further step in the performance of the method.

One of the strands 38 or 40 is then gripped from the end of the tube 10 through which the mandrel 30 was inserted and partially withdrawn from the tube. This causes such strad to form the inner winding 18 as illustrated in FIG. 1. Formation is shown as partially complete in FIG. 7 caused by withdrawal of the strand 38. In general, it is desirable to withdraw approximately one quarter of the original length of the strand from the tube 10.

Once the forming of the inner winding 18 is completed, the configuration is that illustrated in Fig. 1 and to the extent bonding of the strand 16 or 18 to each other or to the tube 10 is desired, such a bonding operation may then be performed.

INDUSTRIAL APPLICABILITY

Figure 8:
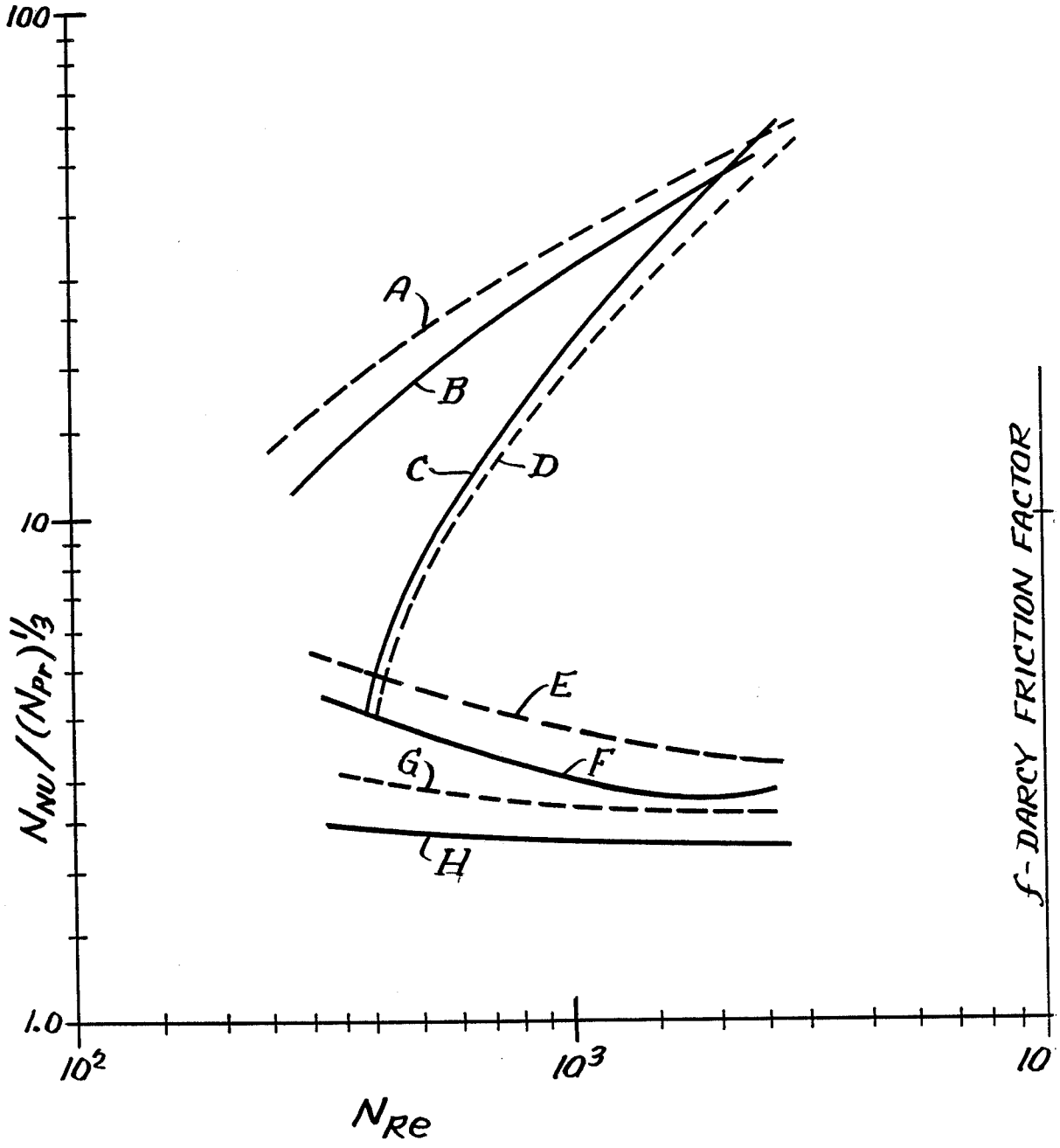
FIG. 8 is a graph comparing the heat transfer performance $[N_{Nu}/(N_{Pr})^{\frac{1}{3}}]$ and the Darcy friction factor (f) of a turbulator structure made according to the invention with the same factors for a so-called double helix turbulator made according to the prior art at varying Reynolds numbers ($N_{Re}$), where $N_{Nu}$ is the Nusselt number and $N_{Pr}$ is the Prandtl number.

FIG. 8 illustrates comparative data for a turbulator and tube construction made according to the invention and so-called double helix turbulator constructions made in the prior art. Eight curves, labeled A–H, inclusive are illustrated. Curves A–D inclusive are plots of heat transfer performance versus Reynolds number, heat transfer performance being defined as $N_{Nu}/N_{Pr})^{\frac{1}{3}}$, where $N_{Nu}$ is the Nusselt number and $N_{Pr}$ is the Prandtl number. Curves E–H are plots of the Darcy friction factor (f) against varying Reynolds numbers.

Curves A, B, E and F all represent the performance of a turbulator and tube construction made according to the invention. Curves A and E utilize the wire diameter of 0.035 inches and with an initial pitch of 0.20 inches. Curves B and F were generated with the construction utilizing a wire diameter of 0.030 inches and a pitch of 0.25 inches.

Curves C, D, G and H all represent the performance of a double helix turbulator structure made according to the prior art. Curves C and H were generated using a wire diameter of 0.030 inches and a pitch of 0.25 inches while curves D and G were generated using a wire diameter of 0.035 inches and a pitch of 0.20 inches.

For all of the curves, the inner diameter of the tube employed was 0.200 inches.

The advantage of a turbulator made according to the invention over the prior art double helix turbulator at low flows can be readily ascertained from the data illustrated in FIG. 8. For example, assuming a desired heat transfer performance of 15.0 out of each of the structures, and employing that form of the invention and the of the prior art utilizing 0.030 inch diameter wire having a 0.25 inch pitch, it will be seen that a turbulator made according to the invention requires a Reynolds number of about 385 with a friction factor of about 4.05. Conversely, the prior art structure requires a Reynolds number of about 750 with a friction factor of 2.3.

Thus, the prior art turbulator requires approximately twice the flow velocity as the inventive turbulator with the consequence that the prior art turbulator must have ½ the number of flow paths as the inventive turbulator. Moreover, the flow length of the prior art unit must be approximately twice the flow length of the inventive unit.

Those skilled in the art will recognize that the pressure drop in a heat exchanger is a function of the friction factor, the flow length, and the square of the fluid velocity. Utilizing the relative values of these quantities obtained from the foregoing analysis, it can be shown that the pressure drop in the prior art unit is on the order of 4.3 times the pressure drop than obtained in a comparable turbulator made according to the prior art to achieve the same heat transfer performance.

Thus it will be appreciated that a turbulator made according to the invention has vastly improved heat transfer efficiency at low Reynolds numbers or flow rates over prior art structures. Furthermore, the ability to achieve comparable heat transfer performance with prior art structures at much lower pressure drops minimizes energy consumption in a pump or the like employed to drive the fluid to the heat exchange system in which the turbulator is employed and likewise may allow the use of physically smaller and lower capacity pumps in such systems thereby providing significant energy, weight and cost savings.

What is claimed is:

1. A turbulator and conduit structure for use in heat exchangers comprising:

an elongated conduit formed of a good heat conductor such as copper, brass or aluminum through which a fluid to be subject to a heat exchange process is adapted to be passed and having inner and outer walls;

a first outer twisted wire winding having a predetermined pitch within said tube in substantial abutment with said inner wall; and a second inner twisted wire winding having a predetermined pitch within said tube and at least partially within said first winding, said second winding having an open center;

the pitch of said first winding being substantially different than the pitch of said second winding.

2. The turbulator and conduit of claim 1 wherein both said windings have the same direction of twist.

3. The turbulator and conduit of claim 1 wherein said conduit is generally circular in cross section and both said windings are helical.

4. The turbulator and conduit of claim 1 wherein the pitch of said second winding is greater than the pitch of said first winding.

5. The turbulator and conduit of claim 4 wherein the pitch of said second winding is in the range of about 2.3–2.7 times the pitch of said first winding and both said windings have the same direction of twist.

6. A turbulator and conduit structure for use in heat exchangers comprising:

an elongated conduit formed of a good heat conductor such as copper, brass or aluminum through which a fluid to be subject to a heat exchange process is adapted to be passed and having inner and outer walls;

a first outer twisted wire winding having a predetermined pitch within said tube in substantial abutment with said inner wall; and a second inner twisted wire winding having a predetermined pitch within said tube and at least partially within said first winding;

the pitch of said first winding being substantially different than the pitch of said second winding;

said conduit being generally circular in cross section with both said windings being helical;

said helical windings each having inner and outer diameters and the inner diameter of said first winding being approximately equal to the outer diameter of said second winding.

7. A turbulator and conduit structure for use in heat exchangers comprising:

an elongated conduit formed of a good heat conductor such as copper, brass or aluminum through which a fluid to be subject to a heat exchange process is adapted to be passed and having inner and outer walls;

an open centered wire turbulator including a first outer twisted winding in substantial abutment with said inner wall along substantially the entirety of the length of said outer winding and a second inner twisted winding within said tube and at least partially within said first winding, the pitch of the pitch of said first winding being substantially different than the twist of the twist of said second winding.

8. A turbulator and conduit structure for use in heat exchangers comprising:

an elongated conduit formed of a good heat conductor such as copper, brass or aluminum through which a fluid to be subject to a heat exchange process is adapted to be passed and having inner and outer walls; and an open centered wire turbulator consisting essentially of a first outer twisted winding having a predetermined pitch within said tube in substantial abutment with said inner wall, and a second inner twisted winding having a predetermined pitch within said tube and at least partially within said first winding the pitch of said first winding being substantially different from the pitch of the second winding.

* * * * *